US009070332B2

(12) United States Patent
Kim et al.

(10) Patent No.: US 9,070,332 B2
(45) Date of Patent: Jun. 30, 2015

(54) DISPLAY DEVICE WITH A POWER SAVING MODE IN WHICH OPERATION OF EITHER THE ODD-LINE GATE DRIVER OR THE EVEN-LINE GATE DRIVER IS HALTED

(75) Inventors: Ji-Sun Kim, Seoul (KR); Chong Chul Chai, Seoul (KR); Yeong-Keun Kwon, Yongin-si (KR); Young-Soo Yoon, Anyang-si (KR); Soo-Wan Yoon, Hwaseong-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 225 days.

(21) Appl. No.: 13/402,054

(22) Filed: Feb. 22, 2012

(65) Prior Publication Data

US 2013/0088479 A1 Apr. 11, 2013

(30) Foreign Application Priority Data

Oct. 11, 2011 (KR) ..... 10-2011-0103525

(51) Int. Cl.
*G09G 3/36* (2006.01)

(52) U.S. Cl.
CPC ..... *G09G 3/3614* (2013.01); *G09G 2310/021* (2013.01); *G09G 3/3677* (2013.01); *G09G 3/3688* (2013.01); *G09G 2310/0283* (2013.01); *G09G 2310/0286* (2013.01); *G09G 2330/021* (2013.01)

(58) Field of Classification Search
CPC ..... G09G 2310/0213; G09G 2330/021; G09G 2330/022; G09G 2310/0224; G09G 2310/0227
USPC ..... 345/60–104, 204–215, 690–699
See application file for complete search history.

(56) References Cited

U.S. PATENT DOCUMENTS

| | | | | |
|---|---|---|---|---|
| 6,545,653 | B1 * | 4/2003 | Takahara et al. | 345/87 |
| 7,019,726 | B2 | 3/2006 | Yokoyama | |
| 7,095,391 | B2 | 8/2006 | Lee | |
| 7,133,013 | B2 * | 11/2006 | Kamezaki et al. | 345/98 |
| 7,639,244 | B2 | 12/2009 | Ku et al. | |
| 7,738,038 | B2 | 6/2010 | Kempf et al. | |
| 2002/0175887 | A1 * | 11/2002 | Yamazaki | 345/87 |
| 2003/0030607 | A1 * | 2/2003 | Kitagawa et al. | 345/87 |
| 2003/0169247 | A1 * | 9/2003 | Kawabe et al. | 345/204 |
| 2003/0197472 | A1 * | 10/2003 | Kanauchi et al. | 315/169.1 |
| 2004/0257322 | A1 * | 12/2004 | Moon | 345/87 |
| 2006/0044251 | A1 | 3/2006 | Kato et al. | |

(Continued)

FOREIGN PATENT DOCUMENTS

| | | |
|---|---|---|
| JP | 2005078098 | 3/2005 |
| JP | 2006084758 | 3/2006 |

(Continued)

*Primary Examiner* — Chanh Nguyen
*Assistant Examiner* — Navin Lingaraju
(74) *Attorney, Agent, or Firm* — Cantor & Colburn LLP

(57) ABSTRACT

A display device includes: an insulation substrate; a plurality of gate lines on the insulation substrate and divided into a first group and a second group; a plurality of data lines insulated from and intersecting the gate lines; a gate driver which applies a gate-on voltage to the gate lines and operates in one of a first mode and a second mode; and a data driver which applies a data voltage to the data lines, where the first group and the second group of the gate lines are applied with the gate-on voltage when the gate driver is in the first mode, and where the first group of the gate lines is applied with the gate-on voltage and the second group of the gate lines is in an off state when the gate driver is in the second mode.

11 Claims, 10 Drawing Sheets

(56) References Cited

U.S. PATENT DOCUMENTS

| | | | | |
|---|---|---|---|---|
| 2006/0209058 | A1* | 9/2006 | Nakamura et al. | 345/211 |
| 2007/0229432 | A1* | 10/2007 | Kimura | 345/96 |
| 2010/0171734 | A1* | 7/2010 | Chiu | 345/212 |
| 2010/0277463 | A1* | 11/2010 | Yen et al. | 345/213 |
| 2012/0044225 | A1* | 2/2012 | Kim et al. | 345/209 |

FOREIGN PATENT DOCUMENTS

| | | |
|---|---|---|
| JP | 2009044438 | 2/2009 |
| JP | 2009168931 | 7/2009 |
| KR | 100764181 | 9/2007 |
| KR | 1020080000340 | 1/2008 |
| KR | 101011383 | 1/2011 |

* cited by examiner

DISPLAY DEVICE WITH A POWER SAVING MODE IN WHICH OPERATION OF EITHER THE ODD-LINE GATE DRIVER OR THE EVEN-LINE GATE DRIVER IS HALTED

This application claims priority to Korean Patent Application No. 10-2011-0103525, filed on Oct. 11, 2011, and all the benefits accruing therefrom under U.S.C. §119, the content of which in its entirety is herein incorporated by reference.

BACKGROUND OF THE INVENTION (a) Field of the Invention

Exemplary embodiments of the invention relate to a display device. More particularly, exemplary embodiments of the invention relate to a display device with reduced power consumption.

(b) Description of the Related Art

A display device is typically included in a computer monitor, a television, a mobile phone, and the like, which are widely used today. The display device may include a cathode ray tube display device, a liquid crystal display and a plasma display device, for example.

The display device typically includes a graphics processing unit ("GPU"), a display panel and a signal controller. The graphics processing unit transmits image data of an image to be displayed on the display panel to the signal controller, and the signal controller generates a control signal for driving the display panel to transmit the control signal together with the image data to the display panel, thereby driving the display device.

Recently, demands on a tablet personal computer ("PC") including a portable computer and a smart phone have been substantially increased. While the tablet PC and the smart phone as the portable devices are typically required to have reduced power consumption, the resolution of the display screen is increased as specifications of the device become more precise such that the power consumption may be increased.

BRIEF SUMMARY OF THE INVENTION

Exemplary embodiments of the invention relate to a display device with reduced power consumption.

An exemplary embodiment of a display device includes: an insulation substrate; a plurality of gate lines on the insulation substrate and divided into a first group and a second group; a plurality of data lines insulated from and intersecting the plurality of gate lines; a gate driver which applies a gate-on voltage to the plurality of gate lines and operates in one of a first mode and a second mode; and a data driver which applies a data voltage to the plurality of data lines, where the first group and the second group of the plurality of gate lines are applied with the gate-on voltage when the gate driver is in the first mode, and where the first group of the plurality of gate lines is applied with the gate-on voltage and the second group of the plurality of gate lines is in an off state when the gate driver is in the second mode.

Another exemplary embodiment of a display device includes: an insulation substrate; a plurality of gate lines on the insulation substrate and divided into an odd-numbered gate line group and an even-numbered gate line group; a plurality of data lines insulated from and intersecting the plurality of gate lines; a gate driver which applies a gate-on voltage to the plurality of gate lines operates in one of a first mode and a second mode; and a data driver which applies a data voltage to the plurality of data lines, where the gate-on voltage is applied to the odd-numbered gate line group and the even-numbered gate line group of the plurality of gate lines when the gate driver is in the first mode, where the gate-on voltage is alternately applied to the odd-numbered gate line group and the even-numbered gate line group of the plurality of gate lines, and where a period with which the gate-on voltage is applied alternately to the odd-numbered gate line group and the even-numbered gate line group in the second mode is substantially equal to at least four frames.

Another exemplary embodiment of a display device includes: an insulation substrate; a plurality of gate lines on the insulation substrate; a plurality of data lines insulated from and intersecting the plurality of gate lines, wherein the plurality of data lines is divided into a first group and a second group; a gate driver which applies a gate-on voltage to the plurality of gate lines; and a data driver applies a data voltage to the plurality of data lines and operates in a first mode and a second mode, where the first group and the second group of the plurality of date lines are applied with the data voltage when the data driver is in the first mode, and where the first group of the plurality of data lines is applied with the data voltage and the second group of the plurality of data lines does not receive the data voltage when the gate driver is in the second mode.

Another exemplary embodiment of a display device includes: an insulation substrate; a plurality of gate lines on the insulation substrate; a plurality of data lines insulated from and intersecting the plurality of gate lines and divided into an odd-numbered data line group and an even-numbered data line group; a gate driver which applies a gate-on voltage to the plurality of gate lines; and a data driver which applies a data voltage to the plurality of data lines and operates in a first mode and a second mode, where the data voltage is applied to the odd-numbered data line group and the even-numbered data line group when the data driver is in the first mode, and where the data voltage is alternately applied to the odd-numbered data line group and the even-numbered data line group when the data driver is in the second mode.

According to exemplary embodiments of the invention, the gate lines or the data lines are selectively and partially driven such that the power consumption of the display device is substantially reduced.

BRIEF DESCRIPTION OF THE DRAWINGS

The above and other aspects and features will become more apparent by describing in further detail exemplary embodiments thereof with reference to the accompanying drawings, in which.

DETAILED DESCRIPTION OF THE INVENTION

Figure 1:
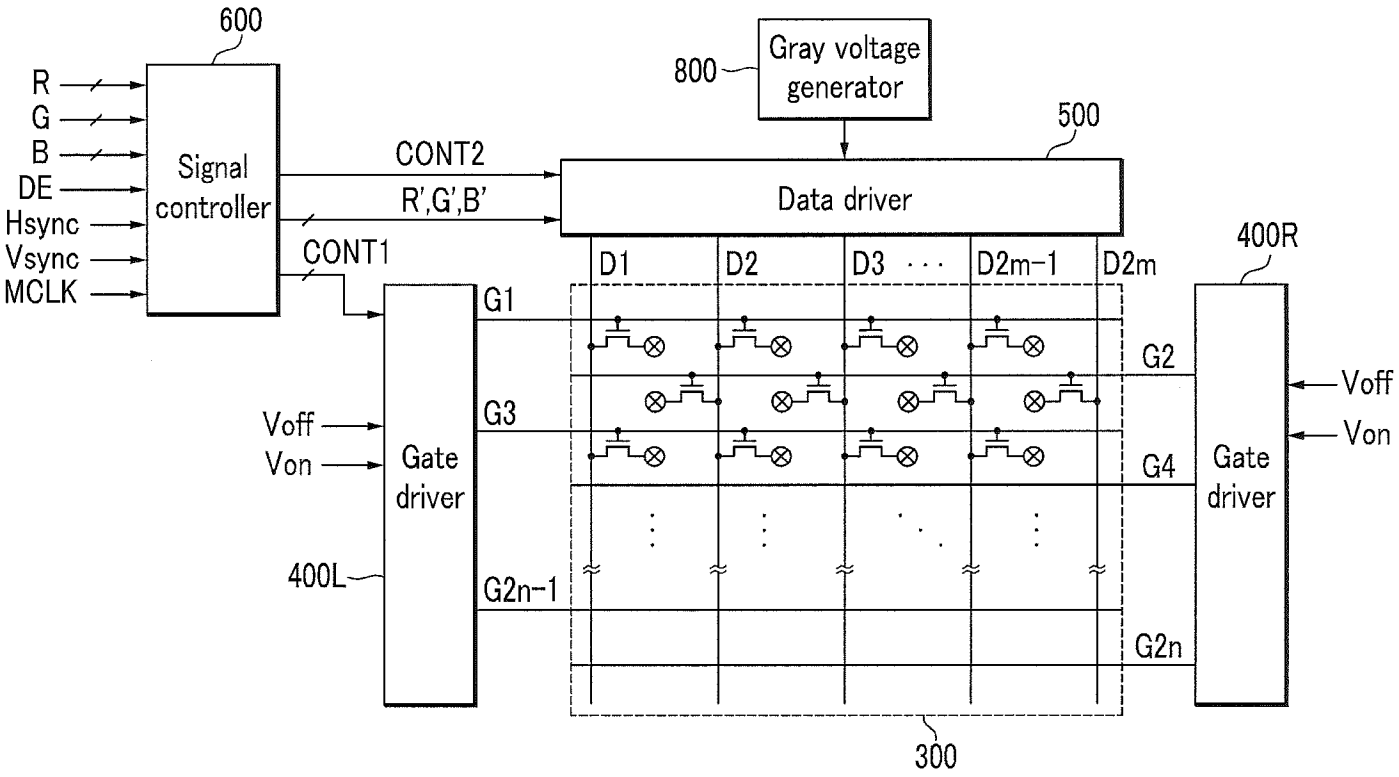
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of a display device according to the invention will be described with reference to the accompanying drawings. In an exemplary embodiment, the display devices may be a liquid crystal display or an organic light emission display device, for example, but not being limited thereto. Hereinafter, exemplary embodiments where the display device is a liquid crystal display will be described for convenience of description.

Figure 2:
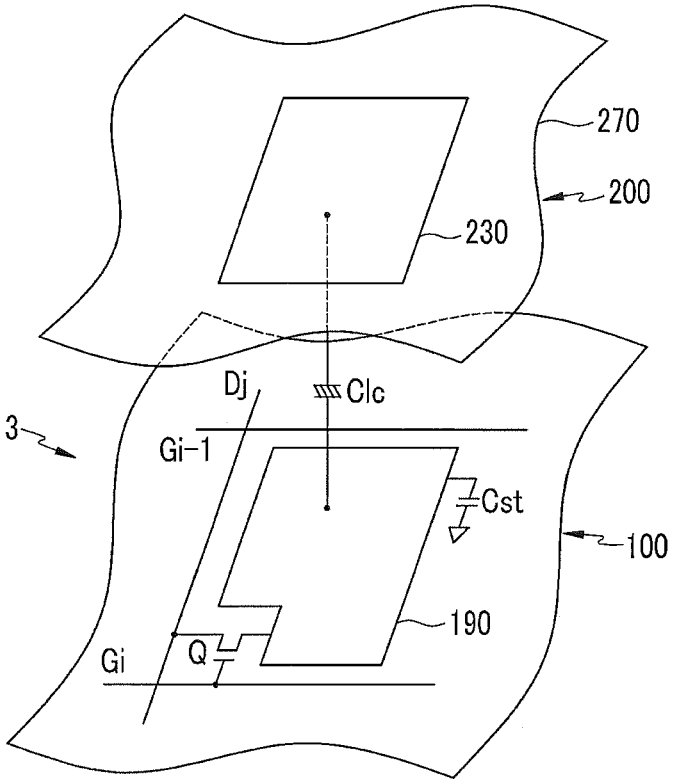
FIG. 2 is an equivalent circuit diagram showing one pixel of an exemplary embodiment of a display device according to the invention.

FIG. 1 is a block diagram showing an exemplary embodiment of a display device according to the invention, and FIG. 2 is an equivalent circuit diagram showing one pixel of an exemplary embodiment of a display device according to the invention.

As shown in FIG. 1, a liquid crystal display includes a liquid crystal panel assembly 300, a plurality of gate drivers, e.g., a left side gate driver 400L and a right side gate driver 400R, connected to the liquid crystal panel assembly 300, a data driver 500 connected to the liquid crystal panel assembly 300, a gray voltage generator 800 connected to the data driver 500, and a signal controller 600 that controls the gate drivers 400L and 400R, the data driver 500 and the gray voltage generator 800.

As shown in FIG. 1, the liquid crystal panel assembly 300 includes an insulation substrate, a plurality of display signal lines G1 to G2*n* and D1 to D2*m*, and a plurality of pixels connected to the display signal lines G1 to G2*n* and arranged substantially in a matrix form.

The display signal lines G1 to G2*n* and D1 to D2*m* include a plurality of gate lines G1 to G2*n* that transmits a gate signal (referred to as "a scanning signal") and a plurality of data lines D1 to D2*m* that transmits a data signal. The gate lines G1 to G2*n* extend substantially in a row direction and substantially parallel to each other, and the data lines D1 to D2*m* extend substantially in a column direction and substantially parallel to each other.

Referring to FIG. 2, each pixel includes a switching element Q connected to the display signal lines G1 to G2*n* and D1 to D2*m*, a liquid crystal capacitor Clc connected to the switching element Q, and a storage capacitor Cst connected to the switching element Q. In an alternative exemplary embodiment, the storage capacitor Cst may be omitted.

In an exemplary embodiment, the switching element Q is a three terminal element, e.g., a thin film transistor, and is provided on a lower panel 100, a control terminal and an input terminal thereof are respectively connected to the gate lines G1 to G2*n* and the data lines D1 to D2*m*, and an output terminal thereof is connected to the liquid crystal capacitor Clc and the storage capacitor Cst. In an exemplary embodiment, switching elements Q are connected to one of the data lines D1 to D2*m* alternately at the right side and the left side thereof. In an exemplary embodiment, the switching elements Q connected to odd-numbered gate lines G1, G3, . . . , G2*n*-1 are connected to the data lines D1 to D2*m* positioned at the left side thereof, and the switching elements Q connected to even-numbered gate lines G2, G4, . . . , G2*n* are connected to the data lines D1 to D2*m* positioned at the right side thereof.

As shown in FIG. 2, the liquid crystal capacitor Clc may be collectively defined by a pixel electrode 190 in the lower panel 100, a common electrode 270 in an upper panel 200, as two terminals thereof, and a liquid crystal layer 3 between the two electrodes 190 and 270 that functions as a dielectric material. The pixel electrode 190 is connected to the switching element Q, and the common electrode 270 is provided on an entire surface of the upper panel 200 and receives a common voltage. In an alternative exemplary embodiment, the common electrode 270 may be provided in the lower panel 100, and in such an embodiment, the pixel and common electrodes 190 and 270 may have a linear shape or a bar shape.

The storage capacitor Cst may be defined collectively by the pixel electrode 190 and a separate signal line (not shown), which is provided on the lower panel 100 overlapping the pixel electrode 190, and the separate signal line is applied with a predetermined voltage such as the common voltage. In an alternative exemplary embodiment, the storage capacitor Cst may be defined collectively by the pixel electrode 190 and a previous gate line Gi-1, provided to be overlapping the pixel electrode 190 via an insulator.

For displaying a color image, each pixel may respectively represent a color, and this is realized by each pixel including a color filter 230 representing one color of red, green or blue ("RGB") in an area facing and overlapping the pixel electrode 190. In an exemplary embodiment, as shown in FIG. 2, the color filter 230 is provided in the corresponding area of the upper panel 200. In an alternative exemplary embodiment, the color filter 230 may be provided over or under the pixel electrode 190 of the lower panel 100.

A polarizer (not shown) that polarizes light may be provided on at least one outer surface of the lower and upper display panels 100 and 200 of the liquid crystal panel assembly 300.

In an exemplary embodiment, the gray voltage generator 800 generates two sets of gray voltages related to transmittance of the pixel. In such an embodiment, one set of the two sets of gray voltages may have positive polarity with respect to the common voltage, and the other set of gray voltages may have negative polarity with respect to the common voltage.

The gate drivers 400L and 400R are disposed at two opposing sides, e.g., the left side and the right side, of the liquid crystal panel assembly 300, respectively, and are connected to the odd-numbered gate lines G1, G3, . . . , G2*n*-1 and the even-numbered gate lines G2, G4, . . . , G2*n*, respectively, to apply a gate signal, including a gate-on voltage Von and a gate-off voltage Voff from outside to the gate lines G1 to G2*n*.

The data driver 500 is connected to the data lines D1 to Dm of the liquid crystal panel assembly 300 and selects a gray voltage from the gray voltage generator 800 to apply the selected gray voltage as a data signal to the pixel. In an exemplary embodiment, the data driver 500 may include a plurality of integrated circuits ("IC"s).

The signal controller 600 generates control signals for controlling the gate drivers 400L and 400R and the data driver 500 and provides a corresponding control signal to each of the gate drivers 400L and 400R and the data driver 500.

Hereinafter, a display operation of the liquid crystal display will now be described in detail.

As shown in FIG. 1, the signal controller 600 receives RGB image signals R, G and B and an input control signal for controlling display of an image, for example, a vertical synchronization signal Vsync, a horizontal synchronizing signal Hsync, a main clock signal MCLK and a data enable signal DE, from an external device, e.g., a graphics controller (not shown). The signal controller 600 generates a gate control signal CONT1 and a data control signal CONT2 based on the input control signal and processes the image signals R, G and B based on the operating conditions of the liquid crystal panel assembly 300, and then outputs the gate control signal CONT1 to the gate drivers 400L and 400R and the data control signal CONT2 and processed image signals R', G' and B' to the data driver 500.

The gate control signal CONT1 includes a scanning start signal for instructing an output start of a gate-on pulse (a gate-on voltage period), a gate clock signal for controlling an output of the gate-on pulse, and an output enable signal for limiting a width of the gate-on pulse.

The data control signal CONT2 includes a horizontal synchronization start signal for instructing an input start of the processed image signals R', G' and B', a load signal for applying the corresponding data voltage to the data lines D1 to D2*m*, an inversion signal for inverting a polarity of the data voltage with respect to the common voltage (hereinafter, "polarity of the data voltage with respect to the common voltage" is referred to as "polarity of the data voltage"), and a data clock signal HCLK.

The gate drivers 400L and 400R apply the gate-on voltage Von to the gate lines G1 to G2*n* based on the gate control signal CONT1 from the signal controller 600 to turn on the switching elements Q connected to the gate lines G1 to G2*n*.

In an exemplary embodiment, one of the left side and right side gate drivers 400L and 400R may be selectively operated and the other may not be operated based on a selection of a user using a switch. In an alternative exemplary embodiment, the left side and right side gate drivers 400L and 400R may be alternately driven by at least one frame units. In an exemplary embodiment, when one of the left side and right side gate drivers 400L and 400R is selectively operated or the left side and right side gate drivers 400L and 400R are alternately operated, the number of clock signals applied to the gate lines may be reduced by half, and a swing speed of the data voltage may be decreased such that power consumption is substantially reduced. Hereinafter, the driving mode described above will be referred to a "power saving mode" or a "second mode", and a mode in which both of the left side and right side gate drivers 400L and 400R are driven is referred to as a "normal mode" or a "first mode". In an exemplary embodiment of a method of driving the display device in the power saving mode, the driving mode of the display device may be converted to the power saving mode, when the image signals R, G and B satisfy a predetermined condition or when the user selects the power saving mode. In an exemplary embodiment, for example, when the gate drivers are in a standby mode in which a backlight thereof is turned off or when the gate drivers are in an icon mode in which wallpaper is displayed, the signal controller 600 may automatically drive the gate drivers 400L and 400R in the power saving mode. In an exemplary embodiment, when the image signals R, G and B are corresponding to a still image such as a joint photographic experts group ("JPEG") file or a tagged image file format ("TIFF") file, the signal controller 600 may automatically drive the gate drivers 400L and 400R in the power saving mode. In an exemplary embodiment, when an image may be substantially roughly displayed, the gate drivers 400L and 400R may be driven in the power saving mode. In an exemplary embodiment, for example, when more than 50% of the entire pixel rows have the same data voltage, the gate drivers 400L and 400R may be driven in the power saving mode.

The data driver 500 sequentially receives the processed image data R', G' and B' corresponding to one pixel row base on the data control signal CONT2 from the signal controller 600, and selects a gray voltage corresponding to each of the processed image signals R', G' and B' from the gray voltages from the gray voltage generator 800, thereby converting the processed image signals R', G' and B' into data voltage corresponding thereto.

In an exemplary embodiment, the data driver 500 generates two data voltages, e.g., a first data voltage Data 1 and a second data voltage Data 2, which are swinging between a positive polarity and a negative polarity with respect to the common voltage while the polarities of the two data voltages are opposite to each other. In an exemplary embodiment, the first data voltage Data 1 may be applied to the odd-numbered data lines and the second data voltage Data 2 may be applied to the even-numbered data lines. In such an embodiment, the gray voltage, which is corresponding to the gray of each pixel of the odd-numbered pixel column and sequentially applied, alternately has the positive polarity and the negative polarity, and the gray voltage, which is corresponding to the gray of each pixel of the even-numbered pixel column and sequentially applied, has a polarity opposite to the polarity of the gray voltage corresponding to the odd-numbered data lines.

In such an embodiment, the gate-on voltage Von is applied to one of the gate lines G1 to G2*n* such the switching elements Q of one row connected thereto are turned on, and the data driver 500 supplies the data voltage to the corresponding data lines D1 to D2*m*. The data voltage supplied to the data lines D1 to D2*m* is applied to the corresponding pixel through the turned-on switching element Q. Here, a period with which the switching elements of one row are turned-on is generally referred to as "1H" or "1 horizontal period". In an exemplary embodiment of the invention, the period, in which the gate-on voltage Von is applied to one row, may be 2H and the gate-on voltage Von that is applied to the neighboring row overlaps by 1H.

In an exemplary embodiment, when the gate drivers are in the normal mode, through this method, the gate-on voltage Von is sequentially applied to all of the gate lines G1 to G2*n* during one frame to apply the data voltage to all pixels. In such an embodiment, when the gate drivers are in the power saving mode, the gate-on voltage Von is sequentially applied to one of the odd numbered gate lines G1, G3, . . . , G2*n*-1 and the even numbered gate lines G2, G4, . . . , G2*n* during one frame such that the data voltage is applied to the pixels of one of the odd-numbered pixel rows and the even-numbered pixel rows. When a next frame starts after one frame ends, the state of the inversion signal applied to the data driver 500 is controlled such that the polarity of the data voltage applied to each pixel in the next frame is inverted with respect to the polarity of the data voltage applied in the frame ("frame inversion"). At this time, in one frame, the polarity of the data voltage that flows in a data line may be inverted (for example, line inversion) or the polarities of the data voltages that are applied to a row of pixels may be inverted (for example, dot inversion) based on the characteristics of the inversion signal.

Next, a structure and an operation of an exemplary embodiment of a gate driver will be described with reference to FIGS. 3 to 6.

Figure 3:
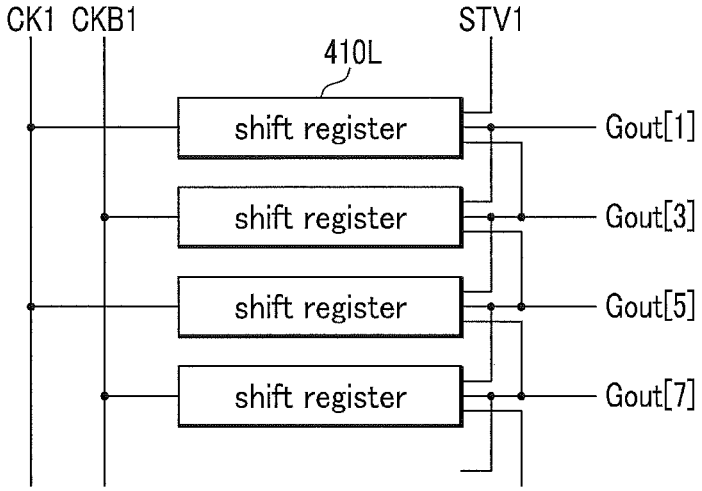
FIG. 3 is a block diagram showing an exemplary embodiment of a left side gate driver of a display device according to the invention.
Figure 4:
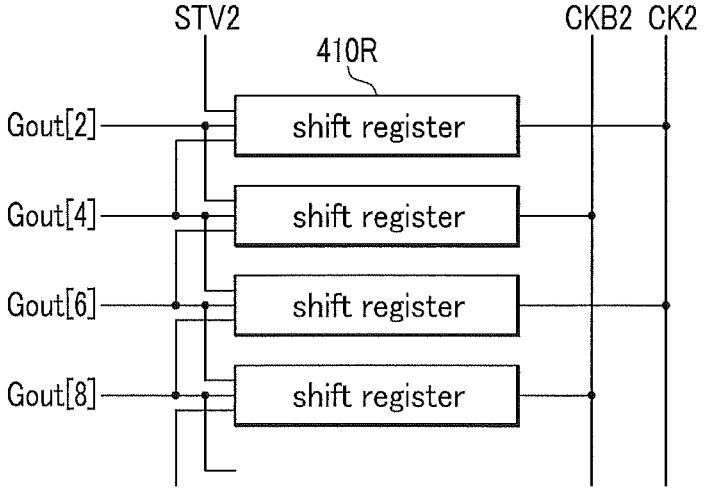
FIG. 4 is a block diagram showing an exemplary embodiment of a right side gate driver of a display device according to the invention.
Figure 5:
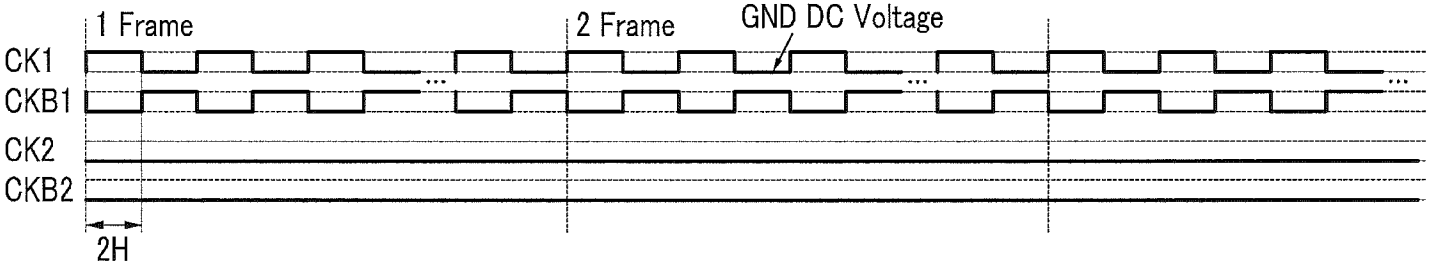
FIG. 5 is a signal timing diagram of clock signals of an exemplary embodiment of a display device according to the invention.
Figure 6:
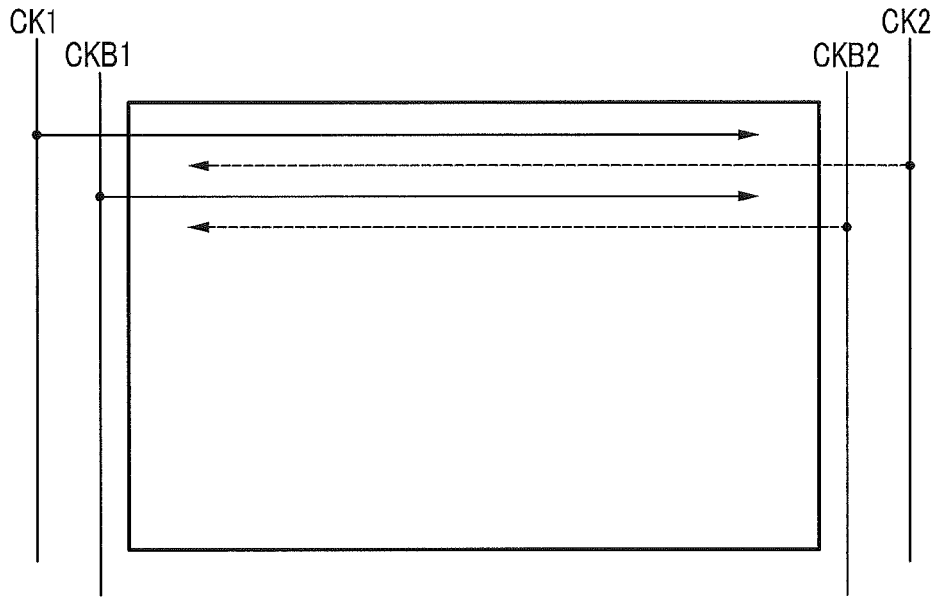
FIG. 6 is a block diagram showing an application of gates signal of an exemplary embodiment of a display device according to the invention.

FIG. 3 is a block diagram showing an exemplary embodiment of a left side gate driver of a display device according to the invention, FIG. 4 is a block diagram showing an exemplary embodiment of a right side gate driver of a display device according to the invention, FIG. 5 is a signal timing diagram of clock signals of an exemplary embodiment of a display device according to the invention, and FIG. 6 is a block diagram showing an application of gate signals of an exemplary embodiment of a display device according to the invention.

As shown in FIGS. 3 and 4, each of the left side and right side the gate drivers 400L and 400R include a plurality of shift registers 410L and 41 OR linearly arranged therein.

In an exemplary embodiment, the shift registers 410L and 410R may be provided on a same substrate during a process for manufacturing the switching elements of the pixels, and the shift registers 410L and 410R may be integrated on a same substrate. In an exemplary embodiment, the shift registers 410L and 410R may be formed together during a same manufacturing process of the liquid crystal panel assembly 300 without providing a separated gate driving IC on the substrate.

The left side and right side gate drivers 400L and 400R may start outputting the gate-on voltage Von based on the scanning start signal, e.g., a first scanning start signal STV1 and a second scanning start signal STV2, of the signal controller 600 and apply the gate-on voltage Von sequentially to the gate lines G1 to G2*n*.

A first shift register 410L of the left side gate driver 400L starts the output of the gate-on voltage Von in synchronization with the first scanning start signal STV1 and a first clock signal CK1, and a second shift register of the left side gate driver 400L starts the output of the gate-on voltage Von in synchronization with the output voltage of a previous shift register thereof, e.g., the first shift register 410L of the left side gate driver 400L, and a first inverted clock signal CKB1. A first shift register 410R of the right side gate driver 400R starts the output of the gate-on voltage Von in synchronization with the second scanning start signal STV2 and a second clock signal CK2, and the second shift register of the right side gate driver 400R starts the output of the gate-on voltage Von in synchronization with the output voltage of a previous shift register thereof, e.g., the first shift register 410R of the right side gate driver 400R, and a second inverted clock signal CKB2. The second scanning start signal STV2 applied to the right side gate driver 400R has a phase that is delayed by 1H from the first scanning start signal STV1 applied to the left side gate driver 400L.

Each of the shift registers 410L of the left side gate driver 400L generates a gate output Gout[N] based on a previous gate output Gout[N−2] and a next gate output Gout[N+2] and in synchronization with the first clock signal CK1 and the first inverted clock signal CKB1. Two neighboring shift registers 410L of the left side gate driver 400L are input with different clock signals, e.g., the first clock signal CK1 and the second clock signal CKB1, which have opposite phases and a period of 4H. The first clock signal CK1 and the first inverted clock signal CKB1 have a high value corresponding to the gate-on voltage Von and a low value corresponding to the gate-off voltage Voff to drive the switching element of the pixel.

Each of the shift register 410R of the right side gate driver 400R generates the gate output Gout[N] based on the previous gate output Gout[N−2] and the next gate output Gout[N+2] and in synchronization with the second clock signal CK2 and the second inverted clock signal CKB2. Two neighboring shift registers 410R of the right side gate driver 400R are input with different clock signals, e.g., the second clock signal CK2 and the second inverted clock signal CKB2, which have opposite phases and a period of 4H. The second clock signal CK2 and the second inverted clock signal CKB2 have a high value corresponding to the gate-on voltage Von and a low value corresponding to the gate-off voltage Voff to drive the switching element of the pixel.

In an exemplary embodiment, when the liquid crystal display is driven in the normal mode, the left side and the right side gate drivers 400L and 400R are both driven such that the left gate driver 400L sequentially applies the gate-on voltage Von in synchronization with the first clock signal CK1 and the first inverted clock signal CKB1 to the odd-numbered gate lines G1, G3, . . . , G2*n*-1, and the right side gate driver 400R sequentially applies the gate-on voltage Von in synchronization with the second clock signal CK2 and the second inverted clock signal CKB2 to the even-numbered gate lines G2, G4, . . . , G2*n*. Accordingly, all of the gate lines G1 to G2*n* are sequentially applied with the gate-on voltage Von being delayed by 1H.

In an exemplary embodiment, when the display device is in the power saving mode based on the selection of the user or the image signal determined as satisfying a condition, one of the left side and right side gate drivers 400L and 400R is operating and the other is not operating. In one exemplary embodiment, for example, the left gate driver 400L is operating and the right gate driver 400R is not operating in the power saving mode. In such an embodiment, the first clock signal CK1 and the first inverted clock signal CKB1 are supplied to the left side gate driver 400L such that the odd-numbered gate lines G1, G3, . . . , G2*n*-1 are sequentially supplied with the gate-on voltage Von, while the second clock signal CK2 and the second inverted clock signal CKB2 are in an off state such that the right side gate driver 400R does not output the gate-on voltage Von. Accordingly, as shown in FIG. 6, the odd-numbered gate lines G1, G3, . . . , G2*n*-1 are applied with the gate-on voltage Von such that the pixels of the odd-numbered pixel row are charged with the data voltage.

Next, the driving of an exemplary embodiment of the liquid crystal display will be described with reference to FIGS. 7 and 8.

Figure 7:
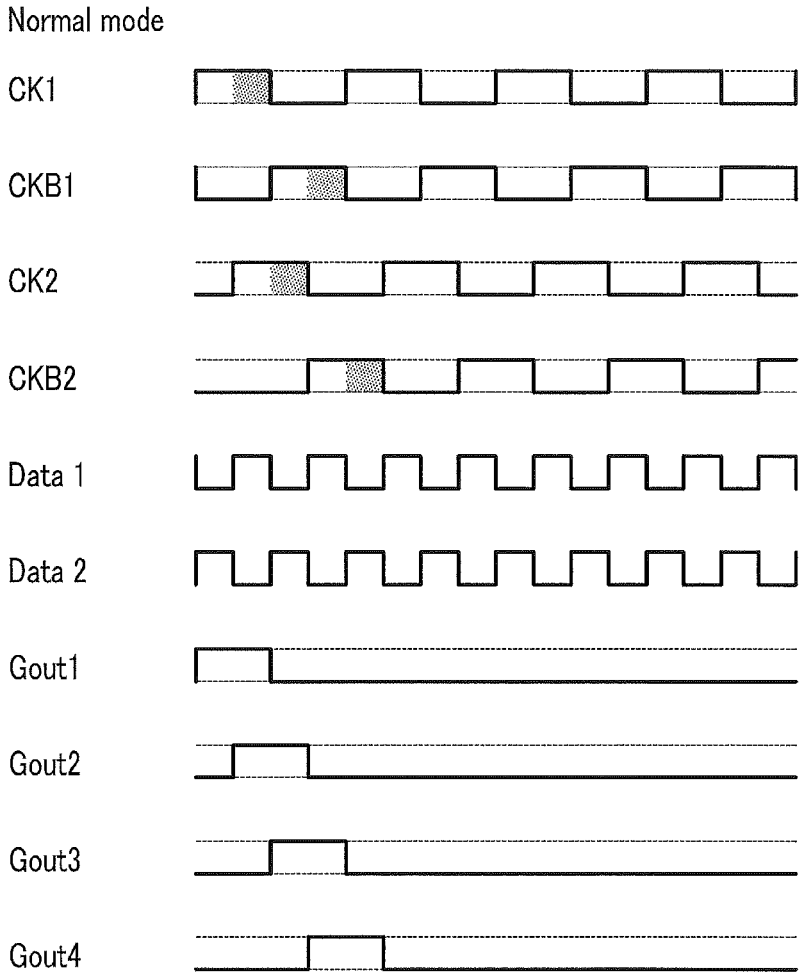
FIG. 7 is a signal timing diagram of signals of an exemplary embodiment of a display device in a normal mode according to the invention.
Figure 8:
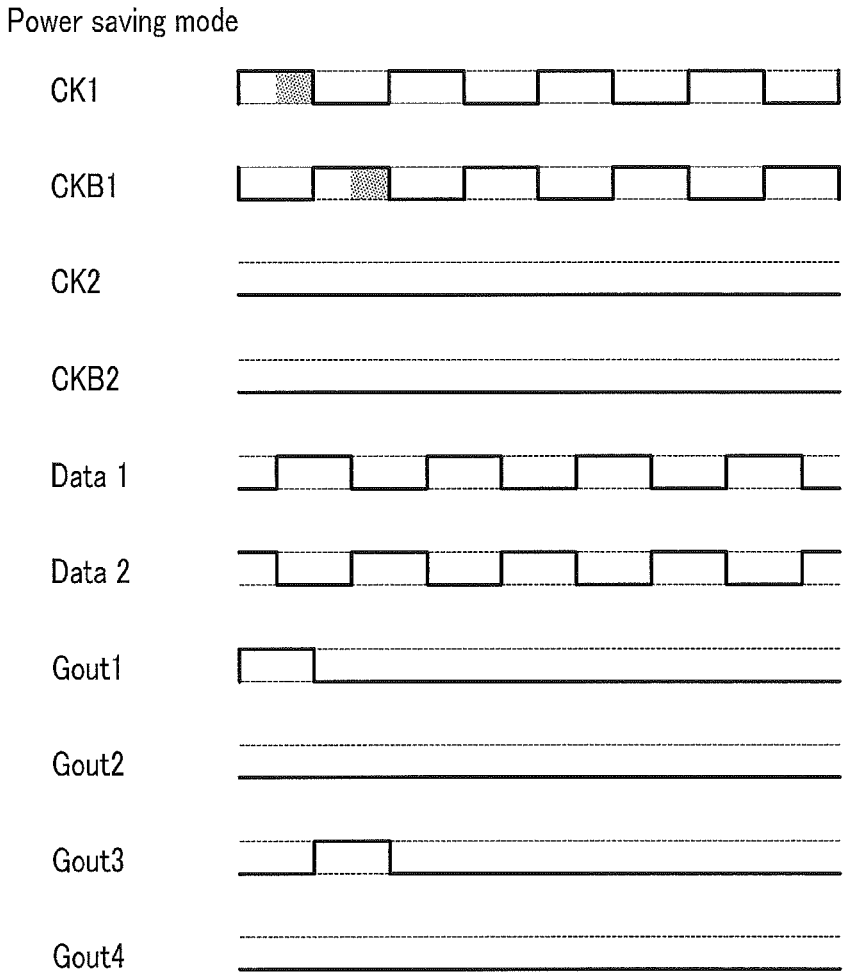
FIG. 8 is a signal timing diagram of signals of an exemplary embodiment of a display device in a power saving mode according to the invention.

FIG. 7 is a signal timing diagram of signals of an exemplary embodiment of a display device in a normal mode according to the invention, and FIG. 8 is a signal timing diagram of signals of an exemplary embodiment of a display device in a power saving mode according to the invention.

FIGS. 7 and 8 show a gate signal, a data voltage signal and various clock signals CK1, CKB1, CK2, and CKB2 applied to left side and right side gate drivers 400L and 400R.

When the liquid crystal display is in the normal mode, as shown in FIG. 7, the signal controller 600 inputs the first clock signal CK1 and the first inverted clock signal CKB1 to the left side gate driver 400L, and after 1H has passed, the right side gate driver 400R is input with the second clock signal CK2 and the second inverted clock signal CKB2. In such an embodiment, when the clock signals CK1, CK2, CKB1, and CKB2 are applied with an interval of 1H, the left side and right side gate drivers 400L and 400R are operating with the interval of 1H. Thus, the length of the high period of the gate signals (Gout1, Gout2, Gout3, Gout4, . . . ) is 2H, and the high period of the gate signals (Gout1, Gout2, Gout3, Gout4, . . . ) and the high period of the neighboring gate signals (Gout1, Gout2, Gout3, Gout4, . . . ) overlaps each other during 1H. In such an embodiment, the high period generation interval of the signal to the odd-numbered gate lines G1 and G3 connected to the left side gate driver 400L is 2H, and the high period generation interval of the signal to the even-numbered gate lines G2 and G4 connected to the right side gate driver 400R is 2H.

In an exemplary embodiment, the data driver 500 applies the first and second data voltages Data1 and Data2 through the data lines D1 to D2*m* to the pixels connected at the right side and the left side of the data lines D1 to D2*m*. In an exemplary embodiment, the first data voltage Data1 is applied to the odd-numbered data lines D1, D3, . . . , D2*m*-1, and the second data voltage Data2 is applied to the even-numbered data lines D2, D4, . . . , D2*m*. The first and second data voltages Data1 and Data2 are swing with a period of 2H, and have polarities opposite to each other. In an exemplary embodiment, a time period during which the voltage is applied to one pixel is 1H. In such an embodiment, the gate-on voltage Von is applied during 2H, and the data voltage is applied to the pixel only during the latter 1H of the 2H.

In an exemplary embodiment, a duration of the gate-on voltage Von of a pixel row Pi and a duration of a next pixel row Pi+1 are overlapping each other and sequentially applied such that the data voltage applied to the pixel row Pi through the turned-on switching element is also applied to the next pixel row Pi+1 to be pre-charged, and is mainly charged by the data voltage of the next pixel row Pi+1 such that the charging efficiency of the data voltage is substantially improved. When the liquid crystal display is in the power saving mode, as shown in FIG. 8, the signal controller 600 only inputs the first clock signal CK1 and the first inverted clock signal CKB1 to the left side gate driver 400L, and does not input the second clock signal CK2 and the second inverted clock signal CKB2 to the right side gate driver 400R. Thus, the odd-numbered gate lines G1 and G3 connected to the left side gate driver 400L only output the gate signals Gout1 and Gout3 having the high period. The high period generation interval of the gate signals Gout1 and Gout3 is 2H.

In an exemplary embodiment, when the data driver 500 applies the first and second data voltages Data1 and Data2 through the data lines D1 to D2*m* to the pixels connected at the right side and the left side of the data lines D1 to D2*m*, the first data voltage Data1 is applied to the odd-numbered data lines D1, D3, . . . , Dm−1, and the second data voltage Data2 is applied to the even-numbered data lines D2, D4, . . . , D2*m*. In such an embodiment, the first and second data voltages Data1 and Data2 are swinging with a period of 4H and have polarities opposite to each other. In such an embodiment, a time period during which the voltage is applied to one pixel is 1H. That is, the first and second data voltages Data1 and Data2 are charged to the pixel only during the time in which the gate signals Gout1 and Gout3 that are maintained during 2H and the first and second data voltages Data1 and Data2 that are maintained during 2H are overlapping each other. As described above, when the liquid crystal display is in the power saving mode in which one of the odd-numbered gate lines G1 and G3 and the even-numbered gate lines G2 and G4 are driven, the swing period of the first and second data voltages Data1 and Data2 may be doubled compared the first and second data voltages Data1 and Data2 in the normal mode.

In an exemplary embodiment, as described above, when the liquid crystal display is in the power saving mode, one of the pairs of the clock signals, e.g., the first clock signal CK1 and the first inverted clock signal CKB1 or the second clock signal CK2 and the second inverted clock signal CKB2, are not applied such that the power consumption of the gate drivers 400L and 400R is substantially reduced. Referring to the power consumption of the gate drivers 400L and 400R, the power consumption by the alternating current ("AC") driving of the clock signal is about 90% of the entire power consumption of the gate drivers 400L and 400R. In the power saving mode, the swing period of the first and second data voltages Data1 and Data2 is doubled compared with the normal mode such that the power consumption is substantially reduced.

In an exemplary embodiment, the first and second data voltages Data1 and Data2 are charged to the pixel only during the time in which the high period of the gate signals Gout1 and Gout3 maintained during 2H and the high period of the first and second data voltages Data1 and Data2 maintained during 2H are overlapping each other in the power saving mode, such that the charging time of the first and second data voltages Data1 and Data2 is substantially increased compared with the normal mode in which the first and second data voltages Data1 and Data2 are charged to the pixel during the period that the high period of the first and second data voltages Data1 and Data2 that are maintained only during 1H and the high period of the gate signals Gout1 and Gout3 or Gout2 and Gout4 are maintained during 2H are overlapping each other. Accordingly, the charging ratio of the pixel is substantially improved in an exemplary embodiment.

In such an embodiment, as described above, although the gate lines are driven by alternate rows in the power saving mode, the resolution of the display device is substantially high such that an image as recognized by a user is substantially the same as in the normal mode.

In an exemplary embodiment, the liquid crystal display includes two gate drivers disposed at both sides of a display panel, but the invention is not limited thereto. In an alternative exemplary embodiment, the two gate drivers may be disposed at one side of the display panel. In an exemplary embodiment, the data driver outputs a pair of data voltages, e.g., the first and second data voltage Data1 and Data2, having opposite polarities to the odd-numbered data lines and the even-numbered data lines, but the invention is not limited thereto. In an alternative exemplary embodiment, the liquid crystal display may include a data driver that applies one data voltage corresponding to a gray to all of the data lines.

An exemplary embodiment of a driving method of a display device according to the invention will now be described.

Figure 9:
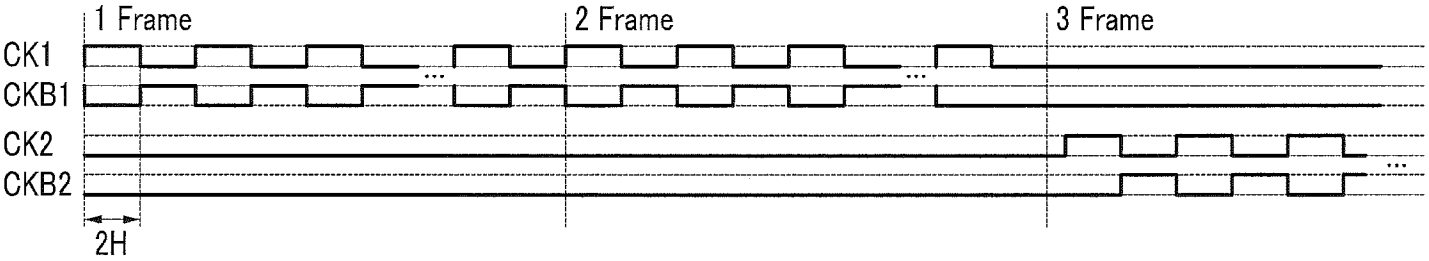
FIG. 9 is a signal timing diagram of clock signals of another exemplary embodiment of a display device according to the invention.

FIG. 9 is a signal timing diagram of clock signals of another exemplary embodiment of a display device according to the invention.

The structure of the display device using the clock signals shown in FIG. 9 is substantially the same as the structure of the exemplary embodiment shown in FIGS. 1 to 4. As disclosed above, the display device using the clock signals shown in FIG. 9 may have the structure in which one gate driver is disposed at one side of the display panel.

In an exemplary embodiment, when the display device is in the power saving mode, only one of two gate drivers, e.g., the left side gate driver 400L and the right side gate driver 400R, is operated and the other of the two gate drivers 400L and 400R is maintained in a non-operation state. In an alternative exemplary embodiment, the two gate drivers 400L and 400R are alternately operated with a period of two or more frames. In such an embodiment, as shown in FIG. 9, the left side gate driver 400L sequentially applies the gate-on voltage Von to the odd-numbered gate lines G1, G3, . . . , G2*n*-1 in synchronization with the first clock signal CK1 and the first inverted clock signal CKB1 in a first frame and a second frame, and the second clock signal CK2 and the second inverted clock signal CKB2 provided to the right side gate driver 400R are maintained as a ground voltage such that the right gate driver 400R does not generate the gate-on voltage Von. In a third frame and a fourth frame, the right side gate driver 400R sequentially applies the gate-on voltage Von in synchronization with the second clock signal CK2 and the second inverted clock signal CKB2 to the even-numbered gate lines G2, G4, . . . , G2*n*, and the first clock signal CK1 and the first inverted clock signal CKB1 provided to the left side gate driver 400L are maintained as the ground voltage such that the left side gate driver 400L does not generate the gate-on voltage Von. In a fifth frame and a sixth frame, the left side gate driver 400L is re-activated and the operation of the right side gate driver 400R is stopped, and in a seventh frame and a eighth frame, in contrast, the right side gate driver 400R is operated and the operation of the left side gate driver 400L is stopped. As described above, the two gate drivers 400L and 400R are alternately driven with a period of four frames. The period, in which two gate drivers 400L and 400R are alternately driven, is not limited to four frames. In an alternative exemplary embodiment, the period, in which the two gate drivers 400L and 400R are alternately driven, may be two frames or six or more frames, for example.

In an exemplary embodiment, the period, in which the two gate drivers 400L and 400R are alternately driven, is four or more frames to prevent the on-and-off switching cycles of the two gate drivers 400L and 400R from being substantially short, e.g., two frames or less, because the power consumption may be substantially increases when the cycle in which the two gate drivers 400L and 400R are alternately driven is substantially short.

In an exemplary embodiment where the clock signals shown in FIG. 9 are used, the reduction of the power consumption, the improvement of the charging efficiency of the pixel due to the omission of a pair of clock signals and the increase of the swing period of the data voltage may be obtained.

Another exemplary embodiment of a driving method of a display device according to the invention will now be described.

Figure 10:
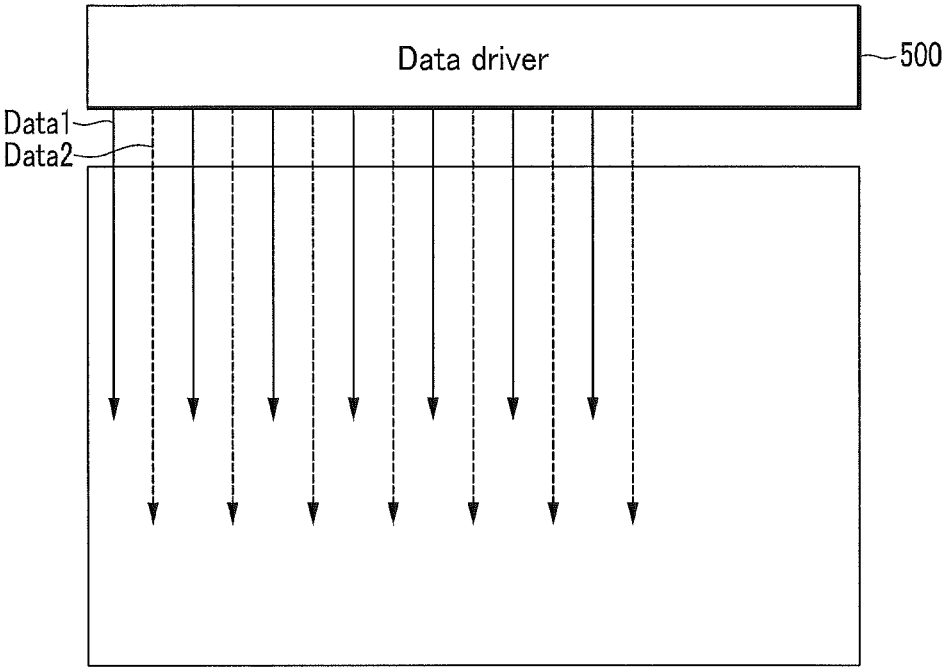
FIG. 10 is a block diagram showing an exemplary embodiment of a driving method of a display device according to the invention.

FIG. 10 is a block diagram showing an exemplary embodiment of a driving method of a display device according to the invention.

In the exemplary embodiments described above, the gate lines are divided into two groups including a first group (e.g., an odd-numbered gate line group) and a second group (e.g., an even-numbered gate line group), and the first group of the two groups is driven or the two groups are alternately driven. In the exemplary embodiment shown in FIG. 10, the data lines are divided into two groups including a first group (e.g., odd-numbered data lines) and a second group (e.g., even-numbered data lines). In such an embodiment, one of the two groups is driven or the two groups are alternately driven such that the power consumption is substantially reduced.

In such an embodiment, the data driver 500 of the display device generates two data voltages, e.g., the first data voltage Data1 and the second data voltage Data2, that are swing between two different polarities, e.g., the positive polarity and the negative polarity, with respect to the common voltage. In such an embodiment, the first data voltage Data1 is applied to the odd-numbered data lines, and the second data voltage Data2 is applied to the even-numbered data lines.

When the display device is in the normal mode, the two data voltages Data1 and Data2 are both applied to the two groups such that all data lines are applied with the one of the two data voltages Data1 and Data2. When the display device is in the power saving mode by the selection of the user, or by an analysis on the image signal based on the predetermined condition, the data driver 500 applies one of the two data voltages Data1 and Data2 and the other of the two data voltages Data1 and Data2 is not generated, or the other of the two data voltages Data1 and Data2 may not be applied to the corresponding data lines although all of the two data voltages Data1 and Data2 are generated. Accordingly, only one of the odd-numbered data lines and the even-numbered data lines is applied with one of the two data voltages Data1 or Data2, and the other is not applied with the data voltage. In such an embodiment, only one of the odd-numbered pixel array or the even numbered pixel array performs the display. In an exemplary embodiment, a data line to which the data voltage is not applied may be applied with the common voltage or the ground voltage.

The odd-numbered data lines and the even-numbered data lines may be alternately driven in a unit of more than two frames. In one exemplary embodiment, for example, only the odd-numbered data lines are applied with the data voltage in a first frame, only the even-numbered data lines are applied with the data voltage in a second frame, the odd-numbered data lines are again applied with the data voltage in a third frame, and the even-numbered data lines are again applied with the data voltage in a fourth frame such that the odd-numbered data lines and the even-numbered data lines are alternately driven in the unit of two frames. In an exemplary embodiment, the period with which the odd-numbered data lines and the even-numbered data lines are alternately driven may be four or more frames.

In an exemplary embodiment, as described above, the data lines are driven with the alternate columns such that the power consumption is substantially reduced.

In such an embodiment, although the data lines are driven with the alternate columns, the resolution of the display device is substantially high such that the images recognized by the user in the power saving mode and in the normal mode is substantially the same.

Another exemplary embodiment of a display device according to the invention will now be described.

Figure 11:
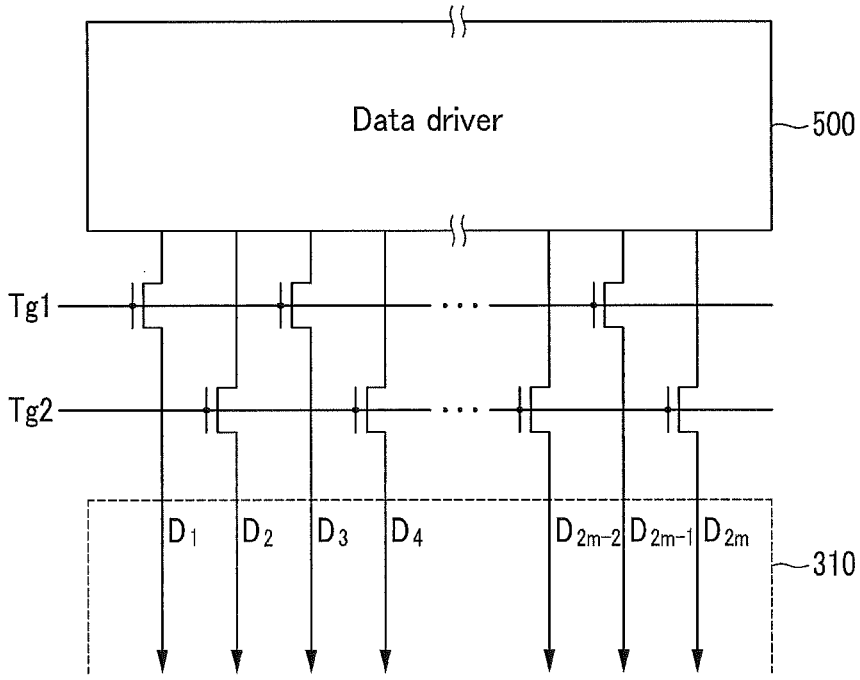
FIG. 11 is a block diagram showing another exemplary embodiment of a display device according to the invention.

FIG. 11 is a block diagram showing another exemplary embodiment of a display device according to the invention.

In an exemplary embodiment, as shown in FIG. 11, the data driver 500 may include transmission gates, e.g., first transmission gate Tg1 and a second transmission gate Tg2, disposed between the data driver 500 and the display unit to alternately drive the data lines.

In an exemplary embodiment, the first transmission gate Tg1 connects the odd-numbered data lines D1, D3, . . . , D2*m*-1 and the data driver 500, and the second transmission gate Tg2 connects the even-numbered data lines D2, D4, . . . , D2*m* and the data driver 500. In such an embodiment, only the odd-numbered data lines may be applied with the data voltage or only the even-numbered data lines may be applied with the data voltage through the on-and-off operation of the transmission gates Tg1 and Tg2. In such an embodiment, the odd-numbered data lines and the even-numbered data lines may be driven with a period of two or more frames.

According to an exemplary embodiment of the invention, the alternate driving of the gate lines and the alternate driving of the data lines may be simultaneously used. In such an embodiment, one of the odd-numbered gate lines and the even-numbered gate lines may be driven or the odd-numbered gate lines and the even-numbered gate lines may be alternately driven, and, at the same time, one of the odd-numbered data lines and the even-numbered data line data lines may be driven or the odd-numbered data lines and the even-numbered data line data lines may be alternately driven.

As described above, according to exemplary embodiments of the invention, when displaying a still image or a rough image in a display area 310, the alternate row or column driving is applied for the gate lines and the data lines by the selection of the user, thereby substantially reducing the power consumption.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

an insulation substrate;

a plurality of gate lines on the insulation substrate and divided into a first group and a second group;

a plurality of data lines insulated from and intersecting the plurality of gate lines;

a gate driver which applies a gate-on voltage to the plurality of gate lines and operates in one of a first mode and a second mode; and a data driver which applies a data voltage to the plurality of data lines, wherein the first group and the second group of the plurality of gate lines are applied with the gate-on voltage when the gate driver is in the first mode, and wherein the first group of the plurality of gate lines is applied with the gate-on voltage each frame and the second group of the plurality of gate lines is in an off state for the entire duration of at least two consecutive frames when the gate driver is in the second mode, wherein the first group of the plurality of gate lines is one of an odd-numbered gate line group and an even-numbered gate line group, the second group of the plurality of gate lines is the other of the odd-numbered gate line group and the even-numbered gate line group, and all of the odd-numbered gates lines are in the odd-numbered gate line group and all of the even-numbered gate lines are in the even-numbered gate line group.

2. The display device of claim 1, wherein the gate driver comprises:

a first gate driver disposed at a first end of the plurality of gate lines and connected to the odd-numbered gate line group; and a second gate driver disposed at a second end of the plurality of gate lines and connected to the even-numbered gate line group.

3. The display device of claim 1, wherein the gate driver operates in one of the first mode and the second mode based on a selection operation of a user using a switch.

4. The display device of claim 1, further comprising: a signal controller which controls the gate driver and the data driver, wherein the signal controller analyses an input image signal transmitted thereto based on a predetermined condition and determines whether the gate driver operates in the first mode or the second mode.

5. The display device of claim 4, wherein the gate driver operates in the second mode when the signal controller determines that the input image signal is corresponding to at least one of a still image, a waiting mode and an icon mode.

6. The display device of claim 1, wherein the plurality of data lines is divided into a first group and a second group, the data driver operates in a first mode or a second mode, the first group and the second group of the plurality of data lines are applied with the data voltage when the data driver is in the first mode, and the first group of the plurality of data lines is applied with the data voltage and the second group of the plurality of data lines is not applied with the data voltage when the data driver is in the second mode.

7. The display device of claim 6, wherein the first group of the plurality of data lines is one of an odd-numbered data line group and an even-numbered data line group, the second group of the plurality of data lines is the other of the odd-numbered data line group and the even-numbered data line group, and the second group of the plurality of data lines is applied with a common voltage or a ground voltage when the data driver is in the second mode.

8. The display device of claim 7, wherein when the gate driver is in the second mode, the data driver is in the second mode.

9. The display device of claim 1, wherein the data driver operates in one of a first mode and a second mode, the plurality of data lines is divided into an odd-numbered data line group and an even-numbered data line group, and the odd-numbered data line group and the even-numbered data line group are applied with the data voltage when the data driver is in the first mode, and the data voltage is alternately applied to the odd-numbered data line group and the even-numbered data line group when the data driver is in the second mode.

10. The display device of claim 1, wherein when the gate driver is in the first mode, durations of the gate-on voltage applied to two neighboring gate lines of the plurality of gate lines are overlapping each other.

11. The display device of claim 1, wherein the gate-on voltage applied to the plurality of gate lines is in synchronization with a first clock signal and a first inverted clock signal having a same pulse width in both the first mode and the second mode.

* * * * *